US007500472B2

(12) United States Patent
Hamada et al.

(10) Patent No.: US 7,500,472 B2
(45) Date of Patent: Mar. 10, 2009

(54) FUEL INJECTION VALVE

(75) Inventors: Takahiro Hamada, Yokohama (JP); Yutaka Mabuchi, Yokohama (JP); Makoto Kano, Yokohama (JP); Yuuji Azuma, Yokohama (JP)

(73) Assignee: Nissan Motor Co., Ltd., Yokohama-shi (JP)

( * ) Notice: Subject to any disclaimer, the term of this patent is extended or adjusted under 35 U.S.C. 154(b) by 671 days.

(21) Appl. No.: 10/823,773

(22) Filed: Apr. 14, 2004

(65) Prior Publication Data

US 2005/0035222 A1 Feb. 17, 2005

(30) Foreign Application Priority Data

Apr. 15, 2003 (JP) ..... 2003-110398

(51) Int. Cl.
*F02M 59/46* (2006.01)
*F02M 59/48* (2006.01)

(52) U.S. Cl. ..... 123/467; 239/533.11; 239/591

(58) Field of Classification Search ..... 123/467, 123/468–470; 239/533.11, 533.2, 585.5, 239/591; 428/408, 469
See application file for complete search history.

(56) References Cited

U.S. PATENT DOCUMENTS

| | | | |
|---|---|---|---|
| 1,461 | A | 12/1839 | Day |
| 2,716,972 | A | 9/1955 | Farny et al. |
| 2,982,733 | A | 5/1961 | Wright et al. |
| 3,211,647 | A | 10/1965 | O'Halloran et al. |
| 3,790,315 | A | 2/1974 | Emanuelsson et al. |
| 3,846,162 | A | 11/1974 | Bloom |
| 3,932,228 | A | 1/1976 | Sugiyama et al. |
| 4,031,023 | A | 6/1977 | Musser et al. |
| 4,367,130 | A | 1/1983 | Lemelson |
| 4,385,880 | A | 5/1983 | Lemelson |
| 4,538,929 | A | 9/1985 | Ehrentraut et al. |
| 4,554,208 | A | 11/1985 | MacIver et al. |

(Continued)

FOREIGN PATENT DOCUMENTS

| | | |
|---|---|---|
| CA | 2009582 | 8/1990 |

(Continued)

OTHER PUBLICATIONS

D.G. Watson et al., "Engineering Drawing Practice," XP002281300, University of Hertfordshire, Sep. 1991, p. 29, Figure 38.

(Continued)

*Primary Examiner*—Mahmoud Gimie
(74) *Attorney, Agent, or Firm*—Foley & Lardner LLP

(57) ABSTRACT

A fuel injection valve for an automotive internal combustion engine comprises a needle valve and an opposite member which are in slidable contact with each other in presence of fuel. A hard carbon thin film is coated on at least one of the sliding sections of the base materials of the needle valve and the opposite member. The hard carbon thin film has a surface hardness ranging from 1500 to 4500 kg/mm$^2$ in Knoop hardness, a film thickness ranging from 0.3 to 2.0 μm, and a surface roughness (Ry) (μm) which satisfies a relationship represented by the following formula (A):

$$Ry<(0.75-Hk/8000)\times h+0.0875 \quad (A)$$

where h is the thickness (μm) of the hard carbon thin film; Hk is the surface hardness in Knoop hardness (kg/mm$^2$) of the hard carbon thin film.

7 Claims, 1 Drawing Sheet

U.S. PATENT DOCUMENTS

| | | | | |
|---|---|---|---|---|
| 4,645,610 | A | | 2/1987 | Born et al. |
| 4,702,808 | A | | 10/1987 | Lemelson |
| 4,712,982 | A | | 12/1987 | Inagaki et al. |
| 4,755,237 | A | | 7/1988 | Lemelson |
| 4,755,426 | A | | 7/1988 | Kokai et al. |
| 4,783,368 | A | | 11/1988 | Yamamoto et al. |
| 4,834,400 | A | | 5/1989 | Lebeck |
| 4,842,755 | A | | 6/1989 | Dunn |
| 4,859,493 | A | | 8/1989 | Lemelson |
| 4,874,596 | A | | 10/1989 | Lemelson |
| 4,919,974 | A | | 4/1990 | McCune et al. |
| 4,933,058 | A | | 6/1990 | Bache et al. |
| 4,943,345 | A | | 7/1990 | Asmussen et al. |
| 4,960,643 | A | | 10/1990 | Lemelson |
| 4,974,498 | A | | 12/1990 | Lemelson |
| 4,980,021 | A | | 12/1990 | Kitamura et al. |
| 4,980,610 | A | | 12/1990 | Varga |
| 4,981,717 | A | | 1/1991 | Thaler |
| 4,988,421 | A | | 1/1991 | Drawl et al. |
| 4,992,082 | A | | 2/1991 | Drawl et al. |
| 4,992,187 | A | * | 2/1991 | Adams et al. ..... 508/179 |
| 5,000,541 | A | | 3/1991 | DiMarcello et al. |
| 5,021,628 | A | | 6/1991 | Lemelson |
| 5,032,243 | A | | 7/1991 | Bache et al. |
| 5,036,211 | A | | 7/1991 | Scott |
| 5,040,501 | A | | 8/1991 | Lemelson |
| 5,067,826 | A | | 11/1991 | Lemelson |
| 5,077,990 | A | | 1/1992 | Plath |
| 5,078,848 | A | | 1/1992 | Anttila et al. |
| 5,087,608 | A | | 2/1992 | Chan et al. |
| 5,096,352 | A | | 3/1992 | Lemelson |
| 5,110,435 | A | | 5/1992 | Haberland |
| 5,112,025 | A | | 5/1992 | Nakayama et al. |
| 5,127,314 | A | | 7/1992 | Swain |
| 5,131,941 | A | | 7/1992 | Lemelson |
| 5,132,587 | A | | 7/1992 | Lemelson |
| 5,142,785 | A | | 9/1992 | Grewal et al. |
| 5,143,634 | A | | 9/1992 | Quinga et al. |
| 5,148,780 | A | | 9/1992 | Urano et al. |
| 5,187,021 | A | | 2/1993 | Vydra et al. |
| 5,190,807 | A | | 3/1993 | Kimock et al. |
| 5,190,824 | A | | 3/1993 | Itoh |
| 5,202,156 | A | | 4/1993 | Yamamoto et al. |
| 5,205,188 | A | | 4/1993 | Repenning et al. |
| 5,205,305 | A | | 4/1993 | Yamakita |
| H1210 | H | | 7/1993 | Jansen |
| 5,232,568 | A | | 8/1993 | Parent et al. |
| 5,237,967 | A | | 8/1993 | Willermet et al. |
| 5,249,554 | A | | 10/1993 | Tamor et al. |
| 5,255,783 | A | | 10/1993 | Goodman et al. |
| 5,255,929 | A | | 10/1993 | Lemelson |
| 5,284,394 | A | | 2/1994 | Lemelson |
| 5,288,556 | A | | 2/1994 | Lemelson |
| 5,295,305 | A | | 3/1994 | Hahn et al. |
| 5,299,937 | A | | 4/1994 | Gow |
| 5,317,938 | A | | 6/1994 | de Juan, Jr. et al. |
| 5,326,488 | A | | 7/1994 | Minokami et al. |
| 5,332,348 | A | | 7/1994 | Lemelson |
| 5,334,306 | A | | 8/1994 | Dautremont-Smith et al. |
| 5,349,265 | A | | 9/1994 | Lemelson |
| 5,358,402 | A | | 10/1994 | Reed et al. |
| 5,359,170 | A | | 10/1994 | Chen et al. |
| 5,360,227 | A | | 11/1994 | Lemelson |
| 5,380,196 | A | | 1/1995 | Kelly et al. |
| 5,401,543 | A | | 3/1995 | O'Neill et al. |
| H1461 | H | | 7/1995 | DiVita et al. |
| 5,432,539 | A | | 7/1995 | Anderson |
| 5,433,977 | A | | 7/1995 | Sarin et al. |
| H1471 | H | | 8/1995 | Braun et al. |
| 5,443,032 | A | | 8/1995 | Vichr et al. |
| 5,447,208 | A | | 9/1995 | Lund et al. |
| 5,456,406 | A | | 10/1995 | Lemelson |
| 5,458,754 | A | | 10/1995 | Sathrum et al. |
| 5,461,648 | A | | 10/1995 | Nauflett et al. |
| 5,462,772 | A | | 10/1995 | Lemelson |
| 5,464,667 | A | | 11/1995 | Köhler et al. |
| 5,466,431 | A | | 11/1995 | Dorfman et al. |
| 5,479,069 | A | | 12/1995 | Winsor |
| 5,482,602 | A | | 1/1996 | Cooper et al. |
| 5,491,028 | A | | 2/1996 | Sarin et al. |
| 5,497,550 | A | | 3/1996 | Trotta et al. |
| 5,509,841 | A | | 4/1996 | Winsor |
| 5,516,729 | A | | 5/1996 | Dawson et al. |
| 5,529,815 | A | | 6/1996 | Lemelson |
| 5,531,878 | A | | 7/1996 | Vadgama et al. |
| 5,541,566 | A | | 7/1996 | Deeney |
| 5,547,716 | A | | 8/1996 | Thaler |
| 5,551,959 | A | | 9/1996 | Martin et al. |
| 5,552,675 | A | | 9/1996 | Lemelson |
| 5,568,391 | A | | 10/1996 | Mckee |
| 5,593,719 | A | | 1/1997 | Dearnaley et al. |
| 5,616,372 | A | | 4/1997 | Conley et al. |
| 5,619,889 | A | | 4/1997 | Jones et al. |
| 5,628,881 | A | | 5/1997 | Lemelson |
| 5,630,275 | A | | 5/1997 | Wexler |
| 5,630,953 | A | | 5/1997 | Klink |
| 5,653,300 | A | | 8/1997 | Lund et al. |
| 5,669,144 | A | | 9/1997 | Hahn et al. |
| 5,672,054 | A | | 9/1997 | Cooper et al. |
| 5,688,557 | A | | 11/1997 | Lemelson et al. |
| 5,707,409 | A | | 1/1998 | Martin et al. |
| 5,714,202 | A | | 2/1998 | Lemelson et al. |
| 5,719,109 | A | | 2/1998 | Tokashiki et al. |
| 5,723,207 | A | | 3/1998 | Lettington et al. |
| 5,731,046 | A | | 3/1998 | Mistry et al. |
| 5,735,769 | A | | 4/1998 | Takemura et al. |
| 5,740,941 | A | | 4/1998 | Lemelson |
| 5,771,873 | A | * | 6/1998 | Potter et al. ..... 123/668 |
| 5,775,817 | A | | 7/1998 | Gottemoller et al. |
| 5,786,038 | A | | 7/1998 | Conley et al. |
| 5,790,146 | A | | 8/1998 | Anderson |
| 5,793,390 | A | | 8/1998 | Claflin et al. |
| 5,794,801 | A | | 8/1998 | Lemelson |
| 5,799,549 | A | | 9/1998 | Decker et al. |
| 5,806,557 | A | | 9/1998 | Helge |
| 5,824,387 | A | | 10/1998 | Boutaghou et al. |
| 5,834,708 | A | | 11/1998 | Svetal et al. |
| 5,843,571 | A | | 12/1998 | Sho |
| 5,851,962 | A | | 12/1998 | Kaga |
| 5,866,195 | A | | 2/1999 | Lemelson |
| 5,871,805 | A | | 2/1999 | Lemelson |
| 5,881,444 | A | | 3/1999 | Schaefer et al. |
| 5,901,021 | A | | 5/1999 | Hirano et al. |
| 5,910,940 | A | | 6/1999 | Guerra |
| 5,927,897 | A | | 7/1999 | Attar |
| 5,937,812 | A | | 8/1999 | Reedy et al. |
| 5,940,975 | A | | 8/1999 | Decker et al. |
| 5,945,214 | A | | 8/1999 | Ma et al. |
| 5,947,710 | A | | 9/1999 | Cooper et al. |
| 5,952,102 | A | | 9/1999 | Cutler |
| 5,958,261 | A | | 9/1999 | Offer et al. |
| 5,960,762 | A | | 10/1999 | Imai |
| 5,967,250 | A | | 10/1999 | Lund et al. |
| 5,968,596 | A | | 10/1999 | Ma et al. |
| 5,975,686 | A | | 11/1999 | Hauck et al. |
| 5,976,707 | A | | 11/1999 | Grab |
| 5,992,268 | A | | 11/1999 | Decker et al. |
| 5,993,938 | A | | 11/1999 | Tsukuda et al. |
| 6,006,415 | A | | 12/1999 | Schaefer et al. |
| 6,015,597 | A | | 1/2000 | David |
| 6,016,000 | A | | 1/2000 | Moslehi |
| 6,023,979 | A | | 2/2000 | Bills et al. |
| 6,028,393 | A | | 2/2000 | Izu et al. |
| 6,051,298 | A | | 4/2000 | Ko et al. |

6,056,443 A 5/2000 Koike et al.
6,059,460 A 5/2000 Ono et al.
6,059,830 A 5/2000 Lippincott, III et al.
6,071,597 A 6/2000 Yang et al.
6,083,313 A 7/2000 Venkatraman et al.
6,083,570 A 7/2000 Lemelson et al.
6,095,690 A 8/2000 Niegel et al.
6,099,541 A 8/2000 Klopotek
6,099,976 A 8/2000 Lemelson et al.
6,106,919 A 8/2000 Lee et al.
6,124,198 A 9/2000 Moslehi
6,139,964 A 10/2000 Sathrum et al.
6,142,481 A 11/2000 Iwashita et al.
6,145,608 A 11/2000 Lund et al.
6,145,763 A * 11/2000 Fleming et al. ..... 239/585.1
6,156,439 A 12/2000 Coffinberry
6,159,558 A 12/2000 Wolfe et al.
6,160,683 A 12/2000 Boutaghou
6,165,616 A 12/2000 Lemelson et al.
6,170,156 B1 1/2001 Lev et al.
6,171,343 B1 1/2001 Dearnaley et al.
6,173,913 B1 1/2001 Shafer et al.
6,190,514 B1 2/2001 Ma et al.
6,193,906 B1 2/2001 Kaneko et al.
6,197,120 B1 3/2001 David
6,197,428 B1 3/2001 Rogers
6,203,651 B1 3/2001 Järvenkylä et al.
6,205,291 B1 3/2001 Hughes et al.
6,207,625 B1 3/2001 Ogano et al.
6,213,075 B1 * 4/2001 Ajayi et al. ..... 123/90.42
6,227,056 B1 5/2001 Bills et al.
6,237,441 B1 5/2001 Nishioka et al.
6,237,852 B1 5/2001 Svetal et al.
6,238,839 B1 5/2001 Tomita et al.
6,255,262 B1 7/2001 Keenan et al.
6,261,424 B1 7/2001 Goncharenko et al.
6,273,793 B1 8/2001 Liners et al.
6,274,220 B1 8/2001 Tsukuda et al.
6,289,593 B1 9/2001 Decker et al.
6,293,648 B1 9/2001 Anderson
6,296,552 B1 10/2001 Boutaghou et al.
6,299,425 B1 10/2001 Hirano et al.
6,305,416 B1 10/2001 Snel et al.
6,309,283 B1 10/2001 Liners et al.
6,311,524 B1 11/2001 Brennan, III et al.
6,316,734 B1 11/2001 Yang
6,322,431 B1 11/2001 Schaenzer et al.
6,322,719 B2 11/2001 Kaneko et al.
6,324,060 B1 11/2001 Hsu
6,325,385 B1 12/2001 Iwashita et al.
6,329,328 B1 12/2001 Koganei et al.
6,333,298 B1 12/2001 Waddoups et al.
6,338,881 B1 1/2002 Sellschopp et al.
6,340,245 B1 1/2002 Horton et al.
6,358,123 B1 3/2002 Liners et al.
6,367,439 B1 * 4/2002 Nishioka et al. ..... 123/90.51
6,367,705 B1 4/2002 Lee et al.
6,368,676 B1 4/2002 Gaudreau et al.
6,377,422 B1 4/2002 Boutaghou et al.
6,379,383 B1 4/2002 Palmaz et al.
6,385,987 B2 5/2002 Schlom et al.
6,386,468 B1 5/2002 Neuberger et al.
6,399,215 B1 6/2002 Zhu et al.
6,401,058 B1 6/2002 Akalin et al.
6,439,845 B1 8/2002 Veres
6,439,986 B1 8/2002 Myoung et al.
6,452,752 B1 9/2002 Boutaghou
6,468,642 B1 10/2002 Bray et al.
6,471,979 B2 10/2002 New et al.
6,482,476 B1 * 11/2002 Liu ..... 427/535
6,494,881 B1 12/2002 Bales et al.
6,514,298 B2 * 2/2003 Haji et al. ..... 44/420
6,523,456 B1 2/2003 Kobayashi et al.
6,524,212 B2 2/2003 Ushijima et al.
6,534,141 B1 3/2003 Hull, Jr. et al.
6,537,310 B1 3/2003 Palmaz et al.
6,537,429 B2 3/2003 O'Donnell et al.
6,543,394 B2 4/2003 Tinney
6,544,308 B2 4/2003 Griffin et al.
6,553,957 B1 4/2003 Ishikawa et al.
6,557,968 B2 5/2003 Lee et al.
6,562,445 B2 5/2003 Iwamura
6,562,462 B2 5/2003 Griffin et al.
6,570,172 B2 5/2003 Kim et al.
6,572,651 B1 6/2003 DeScheerder et al.
6,572,935 B1 6/2003 He et al.
6,572,937 B2 6/2003 Hakovirta et al.
6,585,064 B2 7/2003 Griffin et al.
6,586,069 B2 7/2003 Dykes et al.
6,589,640 B2 7/2003 Griffin et al.
6,592,519 B1 7/2003 Martinez
6,592,985 B2 7/2003 Griffin et al.
6,601,662 B2 8/2003 Matthias et al.
6,626,949 B1 9/2003 Townley
6,629,906 B1 10/2003 Chiba et al.
6,637,528 B2 10/2003 Nishiyama et al.
6,638,569 B2 10/2003 McLaughlin et al.
6,645,354 B1 11/2003 Gorokhovsky
6,656,329 B1 12/2003 Ma et al.
6,658,941 B1 12/2003 Bills et al.
6,666,328 B2 12/2003 Sykora
6,666,671 B1 12/2003 Olver et al.
6,679,231 B2 * 1/2004 Kabat et al. ..... 123/527
6,684,513 B1 2/2004 Clipstone et al.
6,684,759 B1 2/2004 Gorokhovsky
6,695,865 B2 2/2004 Boyle et al.
6,699,106 B2 3/2004 Myoung et al.
6,701,627 B2 3/2004 Korb et al.
6,715,693 B1 4/2004 Dam et al.
6,726,993 B2 4/2004 Teer et al.
6,729,350 B2 5/2004 Schick
6,729,527 B2 5/2004 Sonnenreich et al.
6,733,513 B2 5/2004 Boyle et al.
6,739,214 B2 5/2004 Griffin et al.
6,739,238 B2 5/2004 Ushijima et al.
6,740,393 B1 5/2004 Massler et al.
6,745,742 B2 6/2004 Meyer
6,749,033 B2 6/2004 Griffin et al.
6,752,332 B1 * 6/2004 Terakado et al. ..... 239/585.1
6,753,042 B1 6/2004 Bakounine et al.
6,753,635 B2 6/2004 Kuhlmann-Wilsdorf
6,761,532 B2 7/2004 Capone et al.
6,761,736 B1 7/2004 Woo et al.
6,780,177 B2 8/2004 Shafirstein et al.
6,797,326 B2 9/2004 Griffin et al.
6,799,468 B2 10/2004 Borenstein
6,806,242 B2 10/2004 Shirahama et al.
6,818,029 B2 11/2004 Myoung et al.
6,820,676 B2 11/2004 Palmaz et al.
6,821,189 B1 11/2004 Coad et al.
6,821,624 B2 11/2004 Utsumi et al.
6,822,788 B2 11/2004 Blitstein
6,844,068 B1 1/2005 Miyake et al.
6,849,085 B2 2/2005 Marton
6,855,237 B2 2/2005 Kolpakov et al.
6,855,791 B2 2/2005 Van Doren et al.
6,860,255 B2 * 3/2005 Yamaguchi et al. ..... 123/495
6,861,098 B2 3/2005 Griffin et al.
6,861,137 B2 3/2005 Griffin et al.
6,865,952 B2 3/2005 Bills et al.
6,866,894 B2 3/2005 Trankiem et al.
6,871,700 B2 3/2005 Gorokhovsky
6,872,203 B2 3/2005 Shafirstein et al.
6,878,447 B2 4/2005 Griffin et al.
6,880,469 B2 4/2005 Frost
6,882,094 B2 4/2005 Dimitrijevic et al.

| | | | | |
|---|---|---|---|---|
| 6,883,476 | B1 | 4/2005 | Nohara et al. | |
| 6,886,521 | B2 | 5/2005 | Hamada et al. | |
| 6,887,585 | B2 | 5/2005 | Herbst-Dederichs | |
| 6,890,700 | B2 | 5/2005 | Tomita et al. | |
| 6,893,720 | B1 | 5/2005 | Nakahigashi et al. | |
| 6,969,198 | B2 | 11/2005 | Konishi et al. | |
| 2001/0036800 | A1 | 11/2001 | Liners et al. | |
| 2002/0026899 | A1 | 3/2002 | McLaughlin et al. | |
| 2002/0031987 | A1 | 3/2002 | Liners et al. | |
| 2002/0034631 | A1 | 3/2002 | Griffin et al. | |
| 2002/0034632 | A1 | 3/2002 | Griffin et al. | |
| 2002/0051286 | A1 | 5/2002 | Blitstein | |
| 2002/0070357 | A1 | 6/2002 | Kim et al. | |
| 2002/0074168 | A1 | 6/2002 | Matthias et al. | |
| 2002/0089571 | A1 | 7/2002 | Lee et al. | |
| 2002/0090155 | A1 | 7/2002 | Ushijima et al. | |
| 2002/0090578 | A1 | 7/2002 | Schaefera et al. | |
| 2002/0130219 | A1 | 9/2002 | Parseghian et al. | |
| 2002/0148430 | A1 | 10/2002 | Kano et al. | |
| 2002/0155015 | A1 | 10/2002 | Esumi et al. | |
| 2002/0175476 | A1 | 11/2002 | Chinou et al. | |
| 2003/0012234 | A1 | 1/2003 | Watson et al. | |
| 2003/0019111 | A1 | 1/2003 | Korb et al. | |
| 2003/0019332 | A1 | 1/2003 | Korb et al. | |
| 2003/0021995 | A1 | 1/2003 | Griffin et al. | |
| 2003/0034182 | A1 | 2/2003 | Griffin et al. | |
| 2003/0035957 | A1 | 2/2003 | Griffin et al. | |
| 2003/0035958 | A1 | 2/2003 | Griffin et al. | |
| 2003/0036341 | A1 | 2/2003 | Myoung et al. | |
| 2003/0037640 | A1 | 2/2003 | Griffin et al. | |
| 2003/0069632 | A1 | 4/2003 | De Scheerder et al. | |
| 2003/0084882 | A1* | 5/2003 | Kabat et al. | 123/490 |
| 2003/0089343 | A1* | 5/2003 | Yamaguchi et al. | 123/495 |
| 2003/0108777 | A1 | 6/2003 | Gunsel et al. | |
| 2003/0114094 | A1 | 6/2003 | Myoung et al. | |
| 2003/0128903 | A1 | 7/2003 | Yasuda et al. | |
| 2003/0159919 | A1 | 8/2003 | Fairbairn et al. | |
| 2003/0162672 | A1 | 8/2003 | Shirahama et al. | |
| 2003/0168323 | A1 | 9/2003 | Frost | |
| 2003/0180565 | A1 | 9/2003 | Herbst-Dederichs | |
| 2003/0199741 | A1 | 10/2003 | Martinez | |
| 2003/0234371 | A1 | 12/2003 | Ziegler | |
| 2003/0235691 | A1 | 12/2003 | Griffin et al. | |
| 2004/0003638 | A1 | 1/2004 | Schaefer et al. | |
| 2004/0008406 | A1 | 1/2004 | Blitstein | |
| 2004/0010068 | A1 | 1/2004 | Doren et al. | |
| 2004/0011900 | A1 | 1/2004 | Gebhardt et al. | |
| 2004/0027018 | A1 | 2/2004 | LeBlanc et al. | |
| 2004/0035375 | A1 | 2/2004 | Gibisch et al. | |
| 2004/0045636 | A1* | 3/2004 | Poirier et al. | 148/218 |
| 2004/0074467 | A1 | 4/2004 | Hamada et al. | |
| 2004/0092405 | A1 | 5/2004 | Konishi et al. | |
| 2004/0105806 | A1 | 6/2004 | Griffin et al. | |
| 2004/0109621 | A1 | 6/2004 | Frost | |
| 2004/0115435 | A1 | 6/2004 | Griffin et al. | |
| 2004/0129313 | A1* | 7/2004 | Aharonov et al. | 137/375 |
| 2004/0133301 | A1 | 7/2004 | Van Doren et al. | |
| 2004/0154570 | A1 | 8/2004 | Mabuchi et al. | |
| 2004/0168326 | A1 | 9/2004 | Korb et al. | |
| 2004/0184687 | A1 | 9/2004 | Morales et al. | |
| 2004/0223256 | A1 | 11/2004 | Feng et al. | |
| 2004/0241448 | A1 | 12/2004 | Kano et al. | |
| 2004/0242435 | A1 | 12/2004 | Nishimura et al. | |
| 2004/0244539 | A1 | 12/2004 | Korb et al. | |
| 2004/0261614 | A1 | 12/2004 | Hamada et al. | |
| 2005/0001201 | A1 | 1/2005 | Bocko et al. | |
| 2005/0005892 | A1 | 1/2005 | Nishimura et al. | |
| 2005/0025975 | A1 | 2/2005 | Okamoto et al. | |
| 2005/0037879 | A1 | 2/2005 | Murata et al. | |
| 2005/0056241 | A1 | 3/2005 | Nomura et al. | |
| 2005/0061291 | A1 | 3/2005 | Nishimura et al. | |
| 2005/0061636 | A1 | 3/2005 | Frost et al. | |
| 2005/0064196 | A1 | 3/2005 | Martin et al. | |
| 2005/0082139 | A1 | 4/2005 | Ishikawa et al. | |
| 2005/0084390 | A1 | 4/2005 | Ueno et al. | |
| 2005/0089685 | A1 | 4/2005 | Hamada et al. | |
| 2005/0098134 | A1 | 5/2005 | Nishimura et al. | |
| 2005/0100701 | A1 | 5/2005 | Hamada et al. | |
| 2005/0115744 | A1 | 6/2005 | Griffin et al. | |
| 2005/0188942 | A1 | 9/2005 | Hamada et al. | |

FOREIGN PATENT DOCUMENTS

| | | | |
|---|---|---|---|
| CN | 1128286 | A | 8/1996 |
| DE | 643 034 | | 3/1937 |
| DE | 19507086 | A1 | 9/1996 |
| DE | 19507086 | C2 | 9/1996 |
| DE | 197 04 224 | | 8/1997 |
| DE | 198 15 989 | | 10/1999 |
| DE | 198 25 860 | | 12/1999 |
| DE | 19825860 | A1 | 12/1999 |
| DE | 100 17 459 | | 10/2000 |
| DE | 100 61 397 | A1 | 5/2002 |
| DE | 101 58 683 | | 6/2003 |
| DE | 103 18 135 | A1 | 11/2003 |
| DE | 10337559 | A1 | 3/2005 |
| EP | 0 286 996 | | 10/1988 |
| EP | 0 291 006 | A2 | 11/1988 |
| EP | 0 299 785 | | 1/1989 |
| EP | 0308143 | B1 | 3/1989 |
| EP | 0 333 416 | | 9/1989 |
| EP | 0378378 | A1 | 7/1990 |
| EP | 0384772 | A1 | 8/1990 |
| EP | 0388800 | A2 | 9/1990 |
| EP | 0392125 | A1 | 10/1990 |
| EP | 0398985 | B1 | 11/1990 |
| EP | 407977 | | 1/1991 |
| EP | 0 435 312 | | 7/1991 |
| EP | 0474369 | A1 | 3/1992 |
| EP | 0 500 253 | | 8/1992 |
| EP | 0511153 | A1 | 10/1992 |
| EP | 0 529 327 | | 3/1993 |
| EP | 0392125 | B1 | 3/1993 |
| EP | 0546824 | A1 | 6/1993 |
| EP | 0308143 | A1 | 11/1993 |
| EP | 0573943 | A1 | 12/1993 |
| EP | 0619504 | A1 | 10/1994 |
| EP | 0621136 | A2 | 10/1994 |
| EP | 0624353 | A3 | 11/1994 |
| EP | 0624354 | A3 | 11/1994 |
| EP | 0378378 | B1 | 1/1995 |
| EP | 0651069 | A1 | 5/1995 |
| EP | 0652301 | A1 | 5/1995 |
| EP | 0656458 | A3 | 6/1995 |
| EP | 0 661 470 | | 7/1995 |
| EP | 0396603 | B1 | 6/1996 |
| EP | 0388800 | B1 | 12/1996 |
| EP | 0 759 519 | | 2/1997 |
| EP | 0474369 | B1 | 3/1997 |
| EP | 0 818 622 | A1 | 1/1998 |
| EP | 0652301 | B1 | 1/1998 |
| EP | 0826790 | A1 | 3/1998 |
| EP | 0842754 | A1 | 5/1998 |
| EP | 0 870 820 | | 10/1998 |
| EP | 0816112 | A3 | 10/1998 |
| EP | 0882759 | A1 | 12/1998 |
| EP | 0893677 | B1 | 1/1999 |
| EP | 0624353 | B1 | 2/1999 |
| EP | 0656458 | B1 | 2/1999 |
| EP | 0 905 221 | A1 | 3/1999 |
| EP | 0 905 419 | | 3/1999 |
| EP | 0647318 | B1 | 3/1999 |
| EP | 0651069 | B1 | 3/1999 |
| EP | 0 731 190 | B1 | 5/1999 |
| EP | 0949200 | A1 | 10/1999 |
| EP | 0845154 | B1 | 11/1999 |

| | | | |
|---|---|---|---|
| EP | 0624354 | B1 | 12/1999 |
| EP | 0582676 | B1 | 3/2000 |
| EP | 0990532 | A1 | 4/2000 |
| EP | 1063085 | A1 | 12/2000 |
| EP | 1 067 211 | | 1/2001 |
| EP | 0850126 | B1 | 1/2001 |
| EP | 1076087 | | 2/2001 |
| EP | 1078736 | A1 | 2/2001 |
| EP | 1109196 | A1 | 6/2001 |
| EP | 0778902 | B1 | 9/2001 |
| EP | 1 154 012 | | 11/2001 |
| EP | 0826790 | B1 | 11/2001 |
| EP | 1034320 | B1 | 12/2001 |
| EP | 0850133 | B1 | 1/2002 |
| EP | 0893677 | B1 | 1/2002 |
| EP | 1184480 | A2 | 3/2002 |
| EP | 1190791 | A3 | 4/2002 |
| EP | 1219464 | A2 | 7/2002 |
| EP | 1 233 054 | A1 | 8/2002 |
| EP | 0971812 | B1 | 10/2002 |
| EP | 1018291 | B1 | 10/2002 |
| EP | 1281513 | A2 | 2/2003 |
| EP | 1 300 608 | | 4/2003 |
| EP | 0950123 | B1 | 5/2003 |
| EP | 0882759 | B1 | 6/2003 |
| EP | 1 338 641 | | 8/2003 |
| EP | 1340605 | A1 | 9/2003 |
| EP | 1365141 | A1 | 11/2003 |
| EP | 1083946 | B1 | 12/2003 |
| EP | 1078736 | B1 | 1/2004 |
| EP | 1378271 | A1 | 1/2004 |
| EP | 0757615 | B1 | 3/2004 |
| EP | 0842754 | B1 | 3/2004 |
| EP | 1 411 145 | | 4/2004 |
| EP | 0862395 | B1 | 4/2004 |
| EP | 1 418 353 | A2 | 5/2004 |
| EP | 1440775 | A1 | 7/2004 |
| EP | 1445119 | A1 | 8/2004 |
| EP | 1475557 | A1 | 11/2004 |
| EP | 1481699 | A1 | 12/2004 |
| EP | 1482190 | A2 | 12/2004 |
| EP | 1498597 | A1 | 1/2005 |
| EP | 1 510 594 | A2 | 3/2005 |
| EP | 1311885 | B1 | 3/2005 |
| EP | 1512781 | A2 | 3/2005 |
| EP | 1183470 | B1 | 4/2005 |
| FR | 2 669 689 | | 5/1992 |
| GB | 768226 | | 2/1957 |
| GB | 1005638 | | 10/1988 |
| GB | 2338716 | | 12/1999 |
| JP | 62-111106 | | 5/1987 |
| JP | 63-21209 | A2 | 1/1988 |
| JP | 63-288994 | A2 | 11/1988 |
| JP | 5-70879 | | 3/1993 |
| JP | 5-36004 | | 5/1993 |
| JP | 5-42616 | | 6/1993 |
| JP | 6-264993 | | 9/1994 |
| JP | 6-294307 | A | 10/1994 |
| JP | 7-63135 | A | 3/1995 |
| JP | 7-90553 | A | 4/1995 |
| JP | 7-103238 | | 4/1995 |
| JP | 07-118832 | | 5/1995 |
| JP | 7-41386 | A2 | 10/1995 |
| JP | 7-286696 | | 10/1995 |
| JP | 8-14014 | | 1/1996 |
| JP | 8-61499 | | 3/1996 |
| JP | 9-20981 | A2 | 1/1997 |
| JP | 52006318 | | 1/1997 |
| JP | 253770 | A2 | 9/1997 |
| JP | 10-088369 | A2 | 4/1998 |
| JP | 10-265790 | | 10/1998 |
| JP | 10-298440 | A2 | 11/1998 |
| JP | 11-22423 | | 1/1999 |
| JP | 11-190406 | | 7/1999 |
| JP | 11-292629 | A2 | 10/1999 |
| JP | 11-294118 | | 10/1999 |
| JP | 11-333773 | A2 | 12/1999 |
| JP | 2000-88104 | | 3/2000 |
| JP | 2000-119843 | | 4/2000 |
| JP | 2000-504089 | | 4/2000 |
| JP | 2000-128516 | A | 5/2000 |
| JP | 2000-297373 | | 10/2000 |
| JP | 2000-327484 | | 11/2000 |
| JP | 2000-339083 | | 12/2000 |
| JP | 2001-62605 | | 3/2001 |
| JP | 2001-64005 | | 3/2001 |
| JP | 2001-93141 | A2 | 4/2001 |
| JP | 2001-172766 | A2 | 6/2001 |
| JP | 2001-192864 | | 7/2001 |
| JP | 2001-269938 | | 10/2001 |
| JP | 2001-280236 | | 10/2001 |
| JP | 2002-265968 | A2 | 9/2002 |
| JP | 2002-309912 | | 10/2002 |
| JP | 2002-332571 | A | 11/2002 |
| JP | 2003-13163 | | 1/2003 |
| JP | 2003-13799 | | 1/2003 |
| JP | 2003-25117 | | 1/2003 |
| JP | 2003-28174 | A2 | 1/2003 |
| JP | 2003-88939 | | 3/2003 |
| JP | 2003-113941 | | 4/2003 |
| JP | 2003-147508 | | 5/2003 |
| JP | 2004-36788 | A2 | 2/2004 |
| JP | 2005-68529 | A2 | 3/2005 |
| RU | 2004586 | C1 | 12/1993 |
| RU | 2153782 | C1 | 7/2000 |
| SU | 1770350 | A1 | 10/1992 |
| WO | WO 89/06707 | A1 | 7/1989 |
| WO | WO 89/06708 | A1 | 7/1989 |
| WO | WO 8906338 | A1 | 7/1989 |
| WO | WO 92/02602 | | 2/1992 |
| WO | WO 9206843 | A1 | 4/1992 |
| WO | WO 9219425 | A2 | 11/1992 |
| WO | WO 93/21288 | | 10/1993 |
| WO | WO 93/21289 | | 10/1993 |
| WO | WO 9324828 | A1 | 12/1993 |
| WO | WO 95/20253 | A2 | 7/1995 |
| WO | WO 95/29044 | A1 | 11/1995 |
| WO | WO 95/29273 | A1 | 11/1995 |
| WO | WO 95/31584 | A1 | 11/1995 |
| WO | WO 96/04485 | | 2/1996 |
| WO | WO 96/05333 | A1 | 2/1996 |
| WO | WO 96/05942 | A1 | 2/1996 |
| WO | WO 96/06961 | A1 | 3/1996 |
| WO | WO 96/12389 | A1 | 4/1996 |
| WO | WO 96/24488 | A1 | 8/1996 |
| WO | WO 96/40446 | A1 | 12/1996 |
| WO | WO 97/07531 | A1 | 2/1997 |
| WO | WO 97/10093 | A1 | 3/1997 |
| WO | WO 97/10940 | A1 | 3/1997 |
| WO | WO 97/14555 | | 4/1997 |
| WO | WO 97/16138 | A1 | 5/1997 |
| WO | WO 98/02715 | A1 | 1/1998 |
| WO | WO 98/12994 | A1 | 4/1998 |
| WO | WO 98/13528 | A1 | 4/1998 |
| WO | WO 98/47141 | A1 | 10/1998 |
| WO | WO 99/09547 | A1 | 2/1999 |
| WO | WO 99/12404 | A1 | 3/1999 |
| WO | WO 99/14512 | A1 | 3/1999 |
| WO | WO 99/16371 | A1 | 4/1999 |
| WO | WO 99/22694 | A2 | 5/1999 |
| WO | WO 99/27157 | A1 | 6/1999 |
| WO | WO 99/29477 | A1 | 6/1999 |
| WO | WO 99/31557 | A1 | 6/1999 |
| WO | WO 99/34385 | A1 | 7/1999 |
| WO | WO 99/46847 | A1 | 9/1999 |
| WO | WO 99/54520 | A1 | 10/1999 |

| | | | |
|---|---|---|---|
| WO | WO 99/54934 | A1 | 10/1999 |
| WO | WO 99/57743 | A1 | 11/1999 |
| WO | WO 99/62077 | A1 | 12/1999 |
| WO | WO 99/62572 | A1 | 12/1999 |
| WO | WO 00/22613 | A1 | 4/2000 |
| WO | WO 00/24554 | A1 | 5/2000 |
| WO | WO 00/25410 | A1 | 5/2000 |
| WO | WO 00/28142 | A1 | 5/2000 |
| WO | WO 00/33051 | A1 | 6/2000 |
| WO | WO 00/35000 | A1 | 6/2000 |
| WO | WO 00/44032 | A1 | 7/2000 |
| WO | WO 00/47402 | A1 | 8/2000 |
| WO | WO 00/55385 | A1 | 9/2000 |
| WO | WO 00/56127 | A1 | 9/2000 |
| WO | WO 00/56393 | A1 | 9/2000 |
| WO | WO 00/62327 | A2 | 10/2000 |
| WO | WO 00/68451 | A2 | 11/2000 |
| WO | WO 00/75517 | A1 | 12/2000 |
| WO | WO 00/78504 | A1 | 12/2000 |
| WO | WO 01/05917 | | 1/2001 |
| WO | WO 01/06033 | A1 | 2/2001 |
| WO | WO 01/14736 | A1 | 3/2001 |
| WO | WO 01/14745 | A1 | 3/2001 |
| WO | WO 01/26862 | A1 | 4/2001 |
| WO | WO 01//37631 | A2 | 5/2001 |
| WO | WO 01/40537 | A1 | 6/2001 |
| WO | WO 01/47451 | A1 | 7/2001 |
| WO | WO 01/59544 | A2 | 8/2001 |
| WO | WO 01/61182 | A1 | 8/2001 |
| WO | WO 01/61719 | A1 | 8/2001 |
| WO | WO 01/62372 | A1 | 8/2001 |
| WO | WO 01/63639 | A1 | 8/2001 |
| WO | WO 01/67834 | A1 | 9/2001 |
| WO | WO 01/79583 | A2 | 10/2001 |
| WO | WO 01/80224 | A2 | 10/2001 |
| WO | WO 02/06875 | A1 | 1/2002 |
| WO | WO 02/13188 | A1 | 2/2002 |
| WO | WO 02/24601 | A1 | 3/2002 |
| WO | WO 02/24603 | A1 | 3/2002 |
| WO | WO 02/24970 | A2 | 3/2002 |
| WO | WO 02/32625 | A2 | 4/2002 |
| WO | WO 02/44440 | A1 | 6/2002 |
| WO | WO 02/054454 | A2 | 7/2002 |
| WO | WO 02/062714 | A2 | 8/2002 |
| WO | WO 02/073021 | | 9/2002 |
| WO | WO 02/080996 | A1 | 10/2002 |
| WO | WO 02/085237 | A2 | 10/2002 |
| WO | WO 02/090461 | A1 | 11/2002 |
| WO | WO 02/097289 | A1 | 12/2002 |
| WO | WO 03/009978 | A1 | 2/2003 |
| WO | WO 03/013990 | A1 | 2/2003 |
| WO | WO 03/020329 | A1 | 3/2003 |
| WO | WO 03/021731 | A1 | 3/2003 |
| WO | WO 03/031543 | A2 | 4/2003 |
| WO | WO 03/046508 | A3 | 6/2003 |
| WO | WO 03/054876 | A1 | 7/2003 |
| WO | WO 03/076309 | A2 | 9/2003 |
| WO | WO 03/078679 | A1 | 9/2003 |
| WO | WO 03/091758 | A2 | 11/2003 |
| WO | WO 03/095009 | A1 | 11/2003 |
| WO | WO 03/105134 | A1 | 12/2003 |
| WO | WO 2004/001804 | A2 | 12/2003 |
| WO | WO 2004/004998 | A1 | 1/2004 |
| WO | WO 2004/019809 | A2 | 3/2004 |
| WO | WO 2004/024206 | A1 | 3/2004 |
| WO | WO 2004/026359 | A1 | 4/2004 |
| WO | WO 2004/026500 | A2 | 4/2004 |
| WO | WO 2004/036169 | A1 | 4/2004 |
| WO | WO 2004/036292 | A2 | 4/2004 |
| WO | WO 2004/038701 | A2 | 5/2004 |
| WO | WO 2004/043631 | A1 | 5/2004 |
| WO | WO 2004/048126 | A2 | 6/2004 |
| WO | WO 2004/067466 | A1 | 8/2004 |
| WO | WO 2004/068530 | A1 | 8/2004 |
| WO | WO 2004/071670 | A1 | 8/2004 |
| WO | WO 2004/072959 | A2 | 8/2004 |
| WO | WO 2004/078424 | A2 | 9/2004 |
| WO | WO 2004/084773 | A1 | 10/2004 |
| WO | WO 2004/088113 | A1 | 10/2004 |
| WO | WO 2005/010596 | A2 | 2/2005 |
| WO | WO 2005/011744 | A2 | 2/2005 |
| WO | WO 2005/014760 | A1 | 2/2005 |
| WO | WO 2005/014882 | A1 | 2/2005 |
| WO | WO 2005/016620 | A2 | 2/2005 |
| WO | WO 2005/021851 | A1 | 3/2005 |
| WO | WO 2005/025844 | A1 | 3/2005 |
| WO | WO 2005/034791 | A1 | 4/2005 |
| WO | WO 2005/037144 | A2 | 4/2005 |
| WO | WO 2005/037985 | A2 | 4/2005 |
| WO | WO 2005/040451 | A1 | 5/2005 |
| WO | WO 2005/042064 | A1 | 5/2005 |
| WO | WO 2005/047737 | A1 | 5/2005 |

OTHER PUBLICATIONS

E. Meyer-Rässler et al., "Neuartige Laufflächen-Schutzverfahren für Kolben von Verbrennungsmotoren", VDI- Zeitschrift Bd., Apr. 18, 1942, pp. 245-247, vol. 86, No. 15-16.

"Geometrical Product Specifications (GPS)—Surface Texture: Profile Method—Terms, Definitions and Surface Texture Parameters," Japanese Industrial Standard (JIS B 0601) Machine Elements, 2003, pp. 262-287.

Gählin, Rickard et al., "ME-C:H Coatings in Motor Vehicles," *WEAR* 249, 2001, pp. 302-309.

Hershberger, J., et al., "Evaluation of DLC Coatings for Spark-Ignited, Direct-Injected Fuel Systems," *Surface & Coatings Technology*, 179, 2004, pp. 237-244.

Hershberger, J, et al., "Friction and Wear Behavior of Near-Frictionless Carbon Coatings in Formulated Gasolines," *Surface & Coating Technology*, 183, 2004, pp. 111-117.

Kovalchenko, A., et al., "Friction and Wear Performance of Low-Friction Carbon Coatings Under Oil Lubrication," Energy Technology Div., Argonne National Laboratory.

Ajayi, O., et al., "Effect of Carbon Coating on Scuffing Performance in Diesel Fuels," *Tribology—Transactions*, vol. 44, 2001, pp. 298-304.

Ajayi, O., et al., Effect of Thin-Film Coating on Wear in EGR-Contaminated Oil, Energy Technology Div., Argonne National Laboratory.

Fujimori, N., et al., "Characterization of Conducting Diamond Films," *Vacuum*, vol. 36, Nos. 1-3, 1996, pp. 99-102.

Patent/Literature Search, Bawa Biotechnology Consulting, LLC, Jun. 3, 2005 (201 pages).

"Aluminium Alloy Die Castings," Japanese Industrial Standard (JIS H 5302), 2000, pp. 1-12.

"Aluminium Alloys Castings", Japanese Industrial Standard (JIS H 5202), 1999 (18 pages).

Japanese Industrial Standard, "Aluminium Alloy Castings", JIS H 5202, 1999, pp. 1910, 1911 and 1636-1647.

"Aluminum Alloy Die Castings," JIS H5302 (2000), pp. 1670-1681.

"Assessment of 2nd to 5th Order Irregularities of Surface Configuration by Means of Sections of Surfaces Definitions Relating to Reference System and Dimensions," DIN 4762, UDC 621-288:001.4 (Aug. 1960), pp. 1-4.

API Motor Oil Guide, Which Oil is Right for You, American Petroleum Institute, Copyright 2002.

"Carbon Steels for Machine Structural Use", Japanese Industrial Standard (JIS G 4051), 1979, pp. 1381-1383.

"Carbon Steels for Machine Structural Use", Japanese Industrial Standard (JIS G 4051), 1979, pp. 1-10.

"Chromium Molybdenum Steels," Japanese Industrial Standard (JIS G 4105), 1979, pp. 1-11 (with Translation).

"Chromium Steels," Japanese Industrial Standard (JIS G 4104), 1979, pp. 1-9.

Database WPI, Nov. 28, 2000, Derwent Publications, Ltd., AN 2000640583, XP002240184, JP 2000-327484, Nov. 28, 2000.

Dr. Marx, "Surfaces and Contact Mechanics", XP-002233233, Google, Retrieved from the Internet, Mar. 3, 2003, pp. 1-18.

Engine Oil Viscosity Classification—SAE J300 revised Apr. 1997, p. 133.

"Grey iron castings", Japanese Industrial Standard (JIS G 5501), pp. 2075-2077.

Japanese Industrial Standard, "High Carbon Chromium Bearing Steels", JIS G 4805, 1999, pp. 1-31 (with translation).

International Standard "Application of Carbides for Machining by Chip Removal—Designation of the Main Groups of Chip Removal and Groups of Application," ISO 513, (1975), pp. 67-69.

International Standard, "Petroleum products—Determination of base number—Perchloric acid potentiometric titration method", ISO 3771, second edition Aug. 15, 1994, pp. 1-8.

Japanese Industrial Standard, "Structural Steels with Specified Hardenability Bands", JIS G 4052, 1979, pp. 2414, 2415, 1390-1403, 1410 and 1411.

JIS Japanese Industrial Standard; "Surface Roughness—Definitions and Designation"; JIS B 0601; 1994. (w/Translation).

JIS Japanese Industrial Standard; "Vickers Hardness Test—Test Method"; JIS Z 2244; 1998; (w/Translation).

Japanese Industrial Standard, 2001, No. B 0601.

K. Holmberg et al., "Tribological Characteristics of Diamond-like Carbon Coatings," VTT Symposium, Technical Research Centre of Finland, XP000570636, 1994, pp. 24-238.

Kano et al., "Friction Characteristics of a Hard Carbon Film in Engine Oil, (No. 2) (Surface Analysis Result of Sliding Surface)," Japan Tribology Congress 1999, 5, pp. 11-12.

M. Kano et al., "The Effect of ZDDP and MODTC Additives on Friction Properties of DLC and Steel Cam Follower in Engine Oil", Abstracts of Papers from 2nd World Tribology Congress, Sep. 3-7, 2001, p. 342.

Patent Abstracts of Japan, vol. 1996, No. 09, Sep. 30, 1996, JP 08-128448, May 21, 1996.

Patent Abstracts of Japan, vol. 2000, No. 01, Jan. 31, 2000, JP 11-287329, Oct. 19, 1999.

Patent Abstracts of Japan, vol. 2000, No. 09, Oct. 13, 2000, JP 2000-170768, Jun. 20, 2000.

PCT/IB2004/002552.

"Stainless Steel Bars", Japanese Industrial Standard (JIS G 4303), pp. 1457-1477.

"Standard Practice for Codification of Certain Nonferrous Metals and Alloys, Cast and Wrought1", ASTM International, Designation: B 275-02, Jun. 2002, pp. 1-7.

"Standard Test Method for Calibration and Operation of the Falex Block-on-Ring Friction and Wear Testing Machine", ASTM Designation: D2714-88, Jan. 1989, pp. 383-386.

"Standard Test Method for Separation of Representative Aromatics and Nonaromatics Fractions of High-Boiling Oils by Elution Chromatography", ASTM Designation: D 2549-91 (Reapproved 1995), pp. 895-900.

Steve J. Bull et al., "High-Performance Diamond and Diamond-like Coatings", JOM, Apr. 1995, pp. 16-19, vol. 47, No. 4, XP 000500980.

Patent Abstracts of Japan, vol. 2003, No. 12, Dec. 5, 2003, JP 2004-155891, Jun. 3, 2004.

U.S. Appl. No. 10/911,741, filed May 5, 2004, Ueno.

Ronkainen, Helena, "Tribological Properties of Hydrogenated and Hydrogen-Free Diamond-Like Carbon Coatings," Disseration for the Degree of Doctor of Science in Technology, VTT Publications No. 434.

* cited by examiner

FUEL INJECTION VALVE

BACKGROUND OF THE INVENTION

This invention relates to improvements in a sliding member which is lubricated with fuel, for an automotive vehicle, and more particularly to the improvements in a fuel injection valve for an automotive vehicle, including a needle valve whose sliding section (in slidable contact with an opposite member) is coated with a particular hard carbon thin film so as to be high in durability reliability and realize a low friction coefficient.

Recently, requirements for improving fuel economy and exhaust gas emission control to automotive vehicles have become further stringent, and therefore sliding conditions at sliding sections which are lubricated with fuels become further severe in order to suppress friction at such sliding sections. It has been proposed as a measure to suppress the friction at the sliding sections, that a hard thin film of chromium nitride, titanium nitride or the like is formed at the sliding section of the fuel injection valve as disclosed in Japanese Patent Provisional Publication No. 7-63135, the entire disclosure of which is hereby incorporated by reference.

The largest merits of forming such a hard thin film resides in a point where a remarkably high surface hardness is obtained as compared with a surface treatment such as plating and a surface-hardening treatment such as a heat treatment. By applying such a hard thin film onto the sliding section, it is expected that a wear resistance can be greatly improved. Additionally, under lubrication, such a hard thin film can suppress the degradation of the surface roughness due to wear, and therefore it prevents an opposite member from wearing due to the degraded surface roughness and prevents a frictional force from increasing due to an increase in direct contact (metal contact) with the opposite member, thereby making it possible to maintain a lubricating condition at an initial state for a long time. Furthermore, since the hard thin film itself is hard, it can be possible to make the opposite member adaptable to the hard thin film, and accordingly it can be expected to provide a function to obtain a smoothened surface roughness. As a result, it can be expected that the surface roughness of the both the hard thin film and the opposite member are improved in the lubricating condition.

Now, it has been known that an amorphous carbon film such as a diamond-like carbon (DLC) film which is a kind of hard thin films is high in hardness itself and has a characteristic serving as a solid lubricant itself, so that it exhibits a remarkably low friction coefficient under no lubrication.

As microscopically viewed in lubricating oil, the sliding section is divided into a section where the hard thin film slidably contacts with the opposite member through an oil film, and another section where projections due to the surface roughness (shape) of both the hard thin film and the opposite member directly contact with the facing member making a metal contact. At the latter section where the metal contact is made, an effect of lowering the frictional force generated there can be expected similarly in case of no lubrication, by applying a DLC film at the section. In this regard, it has been investigated to apply the DLC film as a technique for lowering friction in an internal combustion engine.

However, a hard thin film formed by a PVD process or a CVD process is high in internal stress as compared with a surface treatment such as plating and remarkably high in hardness. Accordingly, if the hard thin film is applied to the sliding section of machine parts, the hard thin film tends to peel off from a base material or to form its crack. Concerning such peeling-off of the hard thin film, it has been proposed to soften the internal stress so as to make an improvement by providing a suitable intermediate layer taking account of adhesiveness between the hard thin film and the base material or by applying a multiple layer structure of the hard thin film.

In connection with formation of cracks in the hard thin film itself and peeling-off of the hard thin film due to the cracks, there have hardly been conventional techniques which improve the hard thin film to prevent them by regulating the surface roughness and shape of the hard thin film (particularly, a hard carbon thin film) and them of the opposite member. Only measures which have been hitherto proposed are to form a hard carbon thin film consisting of C, H, Si and inevitable impurities is formed at the surface of the sliding section, regulating the thickness and hardness of the hard carbon thin film as disclosed in Japanese Patent Provisional Publication No. 2002-332571.

SUMMARY OF THE INVENTION

However, as discussed above, although some studies have been made on sliding of the hard carbon thin film consisting of C, H, Si and inevitable impurities, it has not been found to study sliding upon making total judgments on the components, thickness, hardness and surface roughness of the hard carbon thin film, and fuels to be used for fuel injection valves. Particularly, the above hard carbon thin film strongly tends to be brittle as compared with a film of titanium nitride (TiN) or chromium nitrate (CrN), and therefore not only a film formation control in accordance with the property of the film is required but also influences by additives or the like contained in fuel to be used for the fuel injection valve cannot be disregarded. Thus, in the present status, the relationship among the above various matters has not still become apparent.

It is an object of the present invention is to provide an improved fuel injection valve which can effectively overcome drawbacks encountered in conventional fuel injection valves.

Another object of the present invention is to provide an improved fuel injection valve which can ensure its durability reliability, realize a low friction coefficient and is improved in a seizure resistance while being improved in its response characteristics under the realized low friction coefficient.

A further object of the present invention is to provide an improved fuel injection valve whose sliding section is coated with a hard carbon thin film, in which the hard carbon thin film can be effectively prevented from forming crack, peeling-off and the like which occur when the hard carbon thin film which is generally seemed to be low in ductility is applied to the sliding section because it is extremely high in hardness as compared with a film formed by a surface treatment such as plating or the like.

According to the present invention, a fuel injection valve comprises a needle valve including a base material. An opposite member is provided including a base material whose sliding section is in slidable contact with a sliding section of the base material of the needle valve in presence of fuel for an automotive vehicle. Additionally, a hard carbon thin film is coated on at least one of the sliding sections of the base materials of the needle valve and the opposite member. The hard carbon thin film has a surface hardness ranging from 1500 to 4500 kg/mm$^2$ in Knoop hardness, a film thickness ranging from 0.3 to 2.0 μm, and a surface roughness (Ry) (μm) which satisfies a relationship represented by the following formula (A):

$$Ry<(0.75-Hk/8000)\times h+0.0875 \quad (A)$$

where h is the thickness (μm) of the hard carbon thin film; Hk is the surface hardness in Knoop hardness (kg/mm$^2$) of the hard carbon thin film.

BRIEF DESCRIPTION OF THE DRAWING

The single FIGURE is an enlarged fragmentary sectional view of a fuel injection valve according to the present invention.

DETAILED DESCRIPTION OF THE INVENTION

Figure 1:
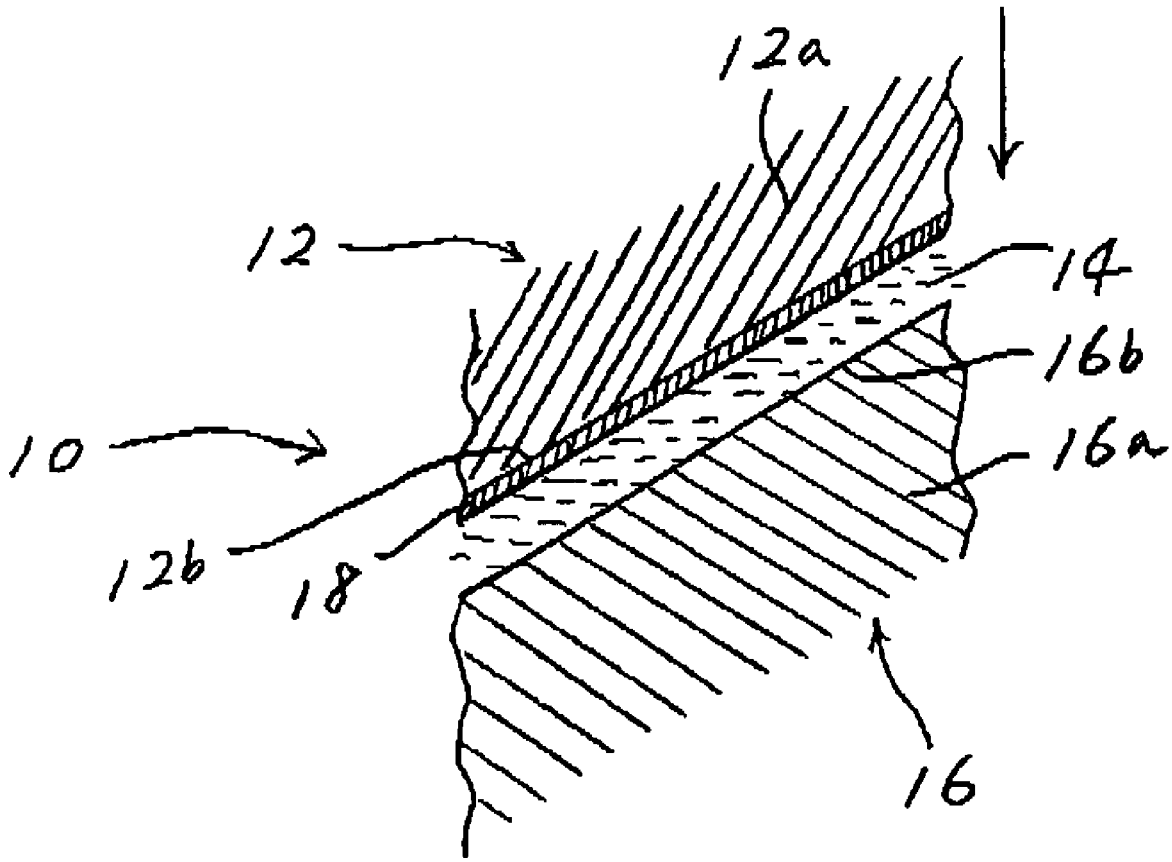

Referring now to the single FIGURE, a fuel injection valve 10 according to the present invention comprises a needle valve 12 which is a sliding member used in presence of fuel 14 for an automotive vehicle. The needle valve 12 includes a base material or main body section 12*a* made of iron-based material or steel, or aluminum-based material. The base material 12*a* of the needle valve 12 has a sliding section or surface 12*b* which is in slidable contact with a sliding section or surface 16*b* of a base material 16*a* of an opposite member 16.

In such a fuel injection valve, the opposite member 16 is a guide (for the needle valve) or a housing constituting the fuel injection valve, so that a hard carbon thin film 18 is formed on the sliding surface 12*a* of the base material 12*a* so as to be slidably coatactable with the opposite member. It will be understood that the base material or main body section 16*a* of the opposite member may be coated at its sliding surface 16*a* with the hard carbon thin film in place of the base material of the needle valve, which will provide the same effects as those in case of the needle valve being coated with the hard carbon thin film. Otherwise, the hard carbon thin film 18 may be formed both on the sliding surfaces 12*b*, 16*a* of the base materials 12*a*,16*a* of the needle valve 12 and the opposite member 16

The base material made of the iron-based material or the like preferably has a surface roughness (center line average roughness) Ra of not larger than 0.03 μm though the surface roughness may be affected by kinds and properties of the sliding member and the automotive fuel, in a state where it has not still been coated with the hard carbon thin film of a certain material. If the surface roughness exceeds 0.03 μm, projecting portions due to the surface roughness of the hard carbon thin film causes a local Hertz's contact pressure to the opposite member to increase, thereby resulting in induction of formation of crack in the hard carbon thin film. The mechanism of this phenomena will be discussed in detail after.

The needle valve of the fuel injection valve according to the present invention is operated in presence of fuel which serves also as a lubricating oil. The fuel contains at least one of ester-based additive and amine-based additive, more specifically, at least one of octane booster, cetane booster, antioxidant, metal deactivator, detergent-dispersant, deicing agent and corrosion inhibitor. It is to be noted that lowering in friction coefficient and improvement in wear resistance can be effectively achieved in the needle valve or the opposite member in presence of such additive(s).

Examples of such additives are fatty acid ester and fatty acid amine compound which have a straight or branched hydrocarbon chain (or group) having a carbon number ranging from 6 to 30, preferably a carbon number ranging from 8 to 24. The additives can be used singly or in suitable combination (or as a mixture). If the carbon number is not within the range of from 6 to 30, the friction coefficient lowering effect cannot be sufficiently obtained. Examples of fatty acid ester are esters which are formed from fatty acid having the straight or branched hydrocarbon chain having the carbon number ranging from 6 to 30 and aliphatic monohydric alcohol or aliphatic polyhydric alcohol. Specific examples of the fatty acid ester compound are glycerol monooleate, glycerol dioleate, sorbitan monooleate, sorbitan dioleate, and the like. Examples of fatty acid amine compound are aliphatic monoamine or alkylene oxide adducts thereof, aliphatic polyamines, imidazoline compound and the like, and derivatives thereof. Specific examples of the fatty acid amine compound are laurylamine, lauryldiethylamine, stearylamine, oleylpropylenediamine, and the like.

Next, the hard carbon thin film coated on the sliding section of the sliding member will be discussed in detail.

The hard carbon thin film used for the fuel injection valve is mainly formed of carbon and is typically a film formed of only carbon except for inevitable impurities. The hard carbon thin film is preferably a DLC (diamond-like carbon) thin film which is formed by a variety of PVD processes, more specifically by an arc ion plating process.

The hard carbon thin film has a surface hardness (Knoop hardness) ranging from 1500 to 4500 kg/mm$^2$, a film thickness ranging from 0.3 to 2.0 μm, and a surface roughness (the maximum height: μm) Ry represented by the following formula (A):

$$Ry<(0.75-Hk/8000)\times h+0.0875 \quad (A)$$

where h is the thickness (μm) of the hard carbon thin film; Hk is the Knoop hardness (kg/mm$^2$) of the hard carbon thin film.

The above formula (A) has been established on the basis of results of analysis made on the experiments in which hard carbon thin films by PVD processes such as the arc ion plating process are formed or coated at the sliding sections of a variety of sliding members, and then the hard carbon thin films were slidingly moved to opposite members. Particularly, the above formula (A) is determined particularly by taking account of relationships among the hardness, surface roughness and thickness of the hard carbon thin films, the shape of the base materials, and the surface roughness and shape of the opposite members particularly in connection with the facts that flaws are formed at the hard carbon thin films and peeling-off of the hard carbon film occurred owing to the flaws during sliding movement of the hard carbon thin film.

Specifically, in all cases that the flaws are formed at the hard carbon thin films upon the sliding movements of the hard carbon thin films, the hard carbon thin films make their cracks so as to microscopically peeled off (forming peeled pieces of the hard carbon thin film) thereby forming the flaws, in which the thus produced peeled piece is dragged so that the flaws were developed further into larger flaws. In this regard, the present inventors have found that factors or causes for producing the flaws are loads to the hard carbon thin films in the all cases, upon which further studies have been made by the present inventors, thus deriving the relationship of the above formula (A).

In contrast, in case that consideration is made only on a Hertz's contact pressure supposed from a line contact between a flat sliding member and an opposite member having a simple curvature as in a conventional technique, it is supposed that such crack does not occur if the film thickness of a hard carbon thin film is relatively thick over a certain level, and therefore the relationship of the above formula (A) is disregarded.

Here, one of causes for making the load to the hard carbon thin film excessive is known to be deposit formed in the hard carbon thin film. This deposit formation is a peculiar phenomena made in a film formed by PVD process such as the arc ion plating process. During formation of the hard carbon thin film, particles coming flying from a target as a raw material of the hard carbon thin film are not in a state of single ion or atom and therefore are in a state of cluster or in a molten state. Thus, the particles in the cluster state or the molten state come flying to the surface of the base material, in which the particles remain as they are in the hard carbon thin film. Additionally, the hard carbon thin film grows around the particles in such a manner as to be piled up, so that the particles are distributed as hard granular projections in the hard carbon thin film.

Such deposits or granular projections tend to readily fall off during sliding movement of the hard carbon thin film. Accordingly, when the deposits or granular projections are caught up in a contacting section between the hard carbon thin film and the opposite member, a pressing force from the opposite member is transmitted through the deposits or granular projections to the hard carbon thin film, in which a local pressure at this site is much higher than a Hertz's contact pressure which is calculated based on macro curvature of the opposite member taking account of elastic deformation, and therefore the local pressure can become a cause for inducing formation of crack in the hard carbon thin film. Further, a shearing force due to sliding contact of the hard carbon thin film to the opposite member is added to the above local pressure, so that flaws develop linearly toward the outer periphery of the hard carbon thin film. This will cause a macro peeling of the hard carbon thin film itself.

Another cause for making the load to the hard carbon thin film excessive is the fact that the opposite member is high in surface roughness. This cause is classified into a first case where projections due to this high surface roughness increases a local Hertz's contact pressure and a second case where a line contact between the sliding member and the opposite member becomes a point contact when the flatness of the sliding member and the opposite member is insufficient. Particularly in the second case, crack of the hard carbon thin film may be largely promoted under a combination effect with the above-mentioned deposits, Besides, in connection with the establishment of the above formula (A), it has become apparent by the analysis that the thickness and hardness of the hard carbon thin film may become factors or causes for formation of crack. More specifically, concerning the thickness, as the thickness of the hard carbon thin film increases, the deformation amount of the hard carbon thin film decreases in case that a particle is pressed at a certain load against the hard carbon thin film, thereby increasing a resistance against the formation of crack relative to the load applied to the hard carbon thin film. As a result, in order to realize a good lubricating condition, a certain film thickness of the hard carbon thin film is required in accordance with the load of sliding conditions of the sliding member. Concerning the harness, in general, a hardness and a ductility of a film are in a contradictory relationship, so that it is known that the ductility lowers as the hardness of the film increases. More specifically, the fact that the hardness of the film is low to a certain degree increases a resistance of the film against formation of crack. It will be understood that this has been also taken into consideration in order to establish the above formula (A).

Hereafter, restriction conditions for the above formula (A) will be discussed in detail.

First, a restriction condition that the film thickness of the hard carbon thin film is not smaller than 0.3 μm is set because crack is unavoidably formed if the film thickness is smaller than 0.3 μm upon taking account of the input force from the corresponding opposite member. Another restricted condition that the film thickness is not larger than 2.0 μm is set because a large residual stress is generated at the step of formation of the hard carbon thin film if the film thickness exceeds 2.0 μm, which leads to a problem of the base material itself warping. Warping of the hard carbon thin film serves to promote the point contact of the hard carbon thin film to the opposite member, and therefore the film thickness exceeding 2.0 μm becomes a factor or cause for indirectly promoting formation of crack of the hard carbon thin film upon an insufficient contact between the sliding member and the opposite member.

The surface roughness of the hard carbon thin film is derived from the relationship between the hardness and thickness of the hard carbon thin film, as set forth below.

An indentation depth h' (provided by particle of the deposit or by projections due to the roughness of the sliding surface) allowable for the hard carbon thin film having the Knoop hardness Hk is experimentally represented by the following equation (1):

$$h'/h=0.6-Hk/10000 \quad (1)$$

where h is the thickness of the hard carbon thin film.

Concerning the surface roughness Ry of the hard carbon thin film, it has been found that a relationship represented by the following equation (2) is established as a result of study on a variety of films:

$$a=0.8Ry-0.07 \quad (2)$$

where a is the height of the deposit remaining in the film.

In case that flaw, crack due to the flaw, or peeling of the film is caused by the deposit present in the hard carbon thin film, it can be prevented from occurrence by controlling the surface roughness of the hard carbon thin film, and therefore it is sufficient that a<h' is satisfied under the fact that the deposit serves as the indentation depth as it is.

Thus, from the above relationship, the above formula (A: Ry<(0.75−Hk/8000)×h+0.0875) is derived.

Additionally, it is preferable that the amount of hydrogen contained as an impurity in the hard carbon thin film is not more than 0.5 atomic %. More specifically, hydrogen is an element which is unavoidably contained or mixed in the hard carbon thin film for the reason why CH (hydrocarbons) based gas is used as a carbon supply source when the hard carbon thin film is formed, for example, by the CVD process. If the content of hydrogen exceeds 0.5 atomic %, the hardness of the hard carbon thin film is lowered thereby degrading the surface roughness of the hard carbon thin film, thus providing a tendency of occurring deterioration of friction.

Next, an appropriate range of the base material to be coated with the hard carbon thin film will be discussed.

Steel such as stainless steel or aluminum-based alloy for weight-lightening is used as the base material to be coated with the hard carbon thin film. The surface roughness of the base material before being coated with the hard carbon thin film influences a surface roughness of the hard carbon thin film after being formed on the base material because the film thickness of the hard carbon thin film is very small. As a result, in case that the surface roughness of the base material is high, projections due to the roughness of the surface of the hard carbon thin film increases a local Hertz's contact pressure, thereby providing a cause for inducing formation of crack in the hard carbon thin film.

The above-mentioned surface roughness Ra (center line average roughness) represents a value which is obtained by averaging the total of the absolute values of deviations of measured lines from the average line of a roughness curve. The maximum height Ry ($R_{max}$) represents the sum of the height of the highest peak and the depth of the deepest trough. The surface roughness Ra and the maximum height Ry are discussed respectively as $R_{a75}$ and $R_z$ in JIS (Japanese Industrial Standard) B 0601 (:2001). In Examples and Comparative Examples discussed hereafter, measurement of the surface roughness was made by using a surface roughness tester under conditions where a measuring length was 48 mm, a measuring speed was 0.5 mm/sec., and a measuring pitch was 0.5 μm.

EXAMPLES

The present invention will be more readily understood with reference to the following Examples in comparison with Comparative Examples; however, these Examples are intended to illustrate the invention and are not to be construed to limit the scope of the invention.

Example 1

A column-like test piece as a base material having a diameter of 18 mm and a length of 22 mm was cut out from a raw material of stainless steel. The surface of this test piece was finished to have a surface roughness Ra of 0.03 μm. Thereafter, a DLC thin film (hard film) was formed at the finished surface of the test piece by an arc ion plating process (PVD), thus producing a specimen of this Example. The formed DLC thin film had a Knoop hardness Hk of 2250 kg/mm$^2$, a maximum height Ry of 0.04 μm, and a thickness h of 0.5 μm, and further had a value (of the right side of the formula (A)) of 0.32.

Comparative Example 1

A column-like test piece which was the same as that in Example 1 was used as a base material. This column-like test piece was used as a specimen of this Comparative Example as it is, without the DLC thin film being formed at the finished surface of the test piece.

Comparative Example 2

A column-like test piece which was the same as that in Example 1 was used as a base material. Thereafter, a TiN film was formed at the finished surface of the test piece, thus producing a specimen of this Comparative Example.

Comparative Example 3

A column-like test piece which was the same as that in Example 1 was used as a base material. Thereafter, a $Cr_2N$ film was formed at the finished surface of the test piece, thus producing a specimen of this Comparative Example.

Comparative Example 4

A column-like test piece which was the same as that in Example 1 was used as a base material. The surface of this test piece was finished to have a surface roughness Ra of 0.1 μm. Thereafter, a DLC thin film as same as that in Example 1 was formed at the finished surface of the test piece by an arc ion plating process (PVD), thus producing a specimen of this Example.

Evaluation Test 1

Each of the specimens of Example and Comparative Examples was subjected to a frictional wear test under test conditions set forth below to measure a friction coefficient and a seizure load at which the specimen occurs its seizure to an opposite member with which the specimen was in sliding contact. Results of this test were tabulated in Table 1.

Test Conditions (a) The opposite member: a disc member (test piece) formed of chromium molybdenum steel and having a diameter of 24 mm and a thickness of 7 mm;

(b) A test system: SRV Test System (Machine No. 39903163) produced by Optimol Instruments Prüftechnik GmbH, in which the specimen made its reciprocating motion upon sliding contact with the disc member (the opposite member);

(c) A frequency of the reciprocating motion: 50 Hz (d) A load applying manner: a load applied to the specimen was increased at a rate of 130 N/min.;

(e) A sliding width: 1 mm; and (f) A test oil: Regular gasoline (in Japan) which was present between the specimen and the disc member.

Evaluation Test 2

Needle valves of fuel injection valves for a gasoline-fueled internal combustion engines were produced respectively corresponding to the specimens of the above Example and Comparative Examples. Each needle valve was produced by coating a base material with a hard film as same as that of the Example or Comparative Example except for the needle valve corresponding to Comparative Example 1. Each needle valve was assembled in a fuel injection valve. Then, a delay in a response time of the fuel injection valve was measured thereby evaluating a response characteristics of the fuel injection valve. Results of the evaluation test 2 were tabulated also in Table 1. The results of the response characteristics are shown as relative values to a standard value (1.00) which is a delay in the response time in the needle valve corresponding to Comparative Example 1.

TABLE 1

| | Surface roughness | | Test results of frictional wear test | | |
|---|---|---|---|---|---|
| Item | Ra (μm) of base material | Hard film | Frictional coefficient | Seizure load (N) | Evaluation of response characteristics |
| Example 1 | 0.03 | DLC | 0.10 | 1040 | 0.80 |
| Comparative Example 1 | | Nil | 0.18 | 650 | 1.00 |
| Comparative Example 2 | | TiN | 0.17 | 710 | 0.96 |
| Comparative Example 3 | | $Cr_2N$ | 0.14 | 800 | 0.92 |
| Comparative Example 4 | 0.1 | DLC | Hard film peeled off during test (no measurement was possible) | | — |

As apparent from the test results in Table 1, Example 1 (and the corresponding needle valve of the fuel injection valve) in which the base material was coated with the DLC thin film as the hard carbon thin film exhibits a low friction coefficient, a high seizure load and a high response characteristics as compared with Comparative Examples 1 to 3 in which the base material was coated with no hard film, or coated with the TiN film or $Cr_2N$ film. Additionally, even in case that the base material was coated with the same DLC thin film, the thin film was unavoidably peeled off during the test in the event that the surface roughness of the base material before being coated with the thin film had been rougher than that in Example 1, as seen from Comparative Example 4.

As appreciated from the above, according to the present invention, the hard carbon thin film, particularly DLC thin film, is suitably controlled in its surface roughness or shape in accordance with the surface hardness and the film thickness. Therefore, the hard carbon thin film can be effectively prevented from cracking, peeling-off and the like which tend to occur when the hard carbon thin film is applied to a sliding section of a fuel injection valve of an automotive vehicle. As a result, the fuel injection valve can ensure its durability reliability, realize a low friction coefficient and be improved in a seizure resistance while being improved in its response characteristics under the realized low friction coefficient.

In the fuel injection valve according to the present invention, a force input condition of load allowable by the hard carbon thin film is determined in accordance with the thickness and hardness of the hard carbon thin film, particularly of the DLC thin film. Accordingly, by suitably regulating factors such as the surface roughness, shape and the like of the hard carbon thin film relative to sliding conditions at the given film and the section to which the film is applied, the force input condition is limited within a certain range, so that the film can be previously prevented from occurrence of crack and peeling-off at the section to which the film is applied, while maintaining its function as a film for a long time.

The entire contents of Japanese Patent Application P2003-110398 (filed Apr. 15, 2003) are incorporated herein by reference.

Although the invention has been described above by reference to certain embodiments and examples of the invention, the invention is not limited to the embodiments and examples described above. Modifications and variations of the embodiments and examples described above will occur to those skilled in the art, in light of the above teachings. The scope of the invention is defined with reference to the following claims.

What is claimed is:

1. A fuel injection valve comprising:

a needle valve including a base material;

an opposite member including a base material whose sliding section is in slidable contact with a sliding section of the base material of the needle valve in presence of fuel for an automotive vehicle; and a hard carbon thin film coated on at least one of the sliding sections of the base materials of the needle valve and the opposite member, the hard carbon thin film having a surface hardness ranging from 1500 to 4500 kg/mm$^2$ in Knoop hardness, a film thickness ranging from 0.3 to 2.0 μm, and a surface roughness (Ry) (μm) which satisfies a relationship represented by the following formula (A):

$$Ry < (0.75 - Hk/8000) \times h + 0.0875 \quad (A)$$

where h is the thickness (μm) of the hard carbon thin film; and Hk is the surface hardness in Knoop hardness (kg/mm$^2$) of the hard carbon thin film.

2. A fuel injection valve as claimed in claim 1, wherein the fuel for an automotive vehicle contains at least one additive selected from the group consisting of an ester-based additive and an amine-based additive.

3. A fuel injection valve as claimed in claim 2, wherein the at least one additive is at least one additive selected from the group consisting of octane booster, cetane booster, antioxidant, metal deactivator, detergent-dispersant, deicing agent, and corrosion inhibitor.

4. A fuel injection valve as claimed in claim 1, wherein the hard carbon thin film contains hydrogen atom in an amount of not more than 0.5 atomic %.

5. A fuel injection valve as claimed in claim 1, wherein the hard carbon thin film is a diamond-like carbon thin film.

6. A fuel injection valve as claimed in claim 5, wherein the diamond-like carbon film is formed by an arc ion plating process.

7. A fuel injection valve as claimed in claim 1, wherein the at least one of the sliding sections of the base materials of the needle valve and the opposite member has a surface roughness (Ra) of not more than 0.03 μm in a condition before the at least one of the sliding sections is coated with the hard carbon thin film.

* * * * *